US008534477B2

(12) United States Patent
Hoffmann et al.

(10) Patent No.: US 8,534,477 B2
(45) Date of Patent: Sep. 17, 2013

(54) CLOSURE SYSTEM FOR CONTAINERS

(75) Inventors: Hans-Rainer Hoffmann, Neuwied (DE); Rudolf Matusch, Marburg (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 13/546,034

(22) Filed: Jul. 11, 2012

(65) Prior Publication Data

US 2012/0273491 A1 Nov. 1, 2012

Related U.S. Application Data

(60) Division of application No. 12/283,231, filed on Sep. 10, 2008, now Pat. No. 8,256,631, which is a continuation-in-part of application No. PCT/EP2007/007211, filed on Aug. 16, 2007.

(30) Foreign Application Priority Data

Aug. 31, 2006 (DE) ..... 10 2006 040 888

(51) Int. Cl.
*B65D 41/62* (2006.01)
*B65D 51/18* (2006.01)

(52) U.S. Cl.
USPC ..... 215/251; 220/254.1

(58) Field of Classification Search
USPC ..... 215/251, 250, 232, 228, 253, 352, 215/341, 316, 200, 345, 344, 343; 220/359.1, 220/254.1, 255.1, 255, 258.1, 258.3, 258.5, 256.1, 319, 315, FOR. 206, FOR. 203, FOR. 186, 378, 200; 222/562; D9/436, 435
IPC ..... B65D 39/02, 41/62, 41/00
See application file for complete search history.

(56) References Cited

U.S. PATENT DOCUMENTS 1,480,782 A * 1/1924 Primeau ..... 220/319

(Continued)

FOREIGN PATENT DOCUMENTS

DE 90 11 309 U1 10/1990
FR 2 373 454 A 7/1978

OTHER PUBLICATIONS

DIN ISO 11 040 Part 2, Oct. 31, 1983, "Prefilled syringes; Plungers and discs for dental local anesthetic cartridges", no translation.

(Continued)

*Primary Examiner* — Robert J Hicks
(74) *Attorney, Agent, or Firm* — R. S. Lombard; K. Bach

(57) ABSTRACT

A closure system for containers used for storing or administering substances in the form of liquids, pastes or powders that allows the container to be securely closed permanently and in a virus-proof, bacteria-proof and spore-proof manner. The container having an opening that is to be closed, a cap provided with a through-hole, the cap including a substantially cylindrical securing area, and a closure element for sealing the opening. The container includes an end face which surrounds the opening and on which the closure element bears. The closure element comprises a virus-proof, bacteria-proof and spore-proof film, and the cap comprises at least one closed, elastic sealing lip bearing resiliently in a direction towards the closure element in the operative position.

7 Claims, 6 Drawing Sheets

(56) References Cited

U.S. PATENT DOCUMENTS

| | | | | |
|---|---|---|---|---|
| 2,848,145 | A * | 8/1958 | Livingstone | 222/542 |
| 3,001,658 | A | 9/1961 | Herter | |
| 3,275,203 | A * | 9/1966 | Nossal et al. | 215/253 |
| 3,913,771 | A * | 10/1975 | Acton et al. | 215/256 |
| 2003/0121877 | A1 * | 7/2003 | Brozell et al. | 215/220 |
| 2006/0163193 | A1 * | 7/2006 | Smeyak et al. | 215/344 |

OTHER PUBLICATIONS

DIN ISO 11 040 Part 3, Nov. 1993, "Prefillen syringes; Aluminum caps for dental local anesthetic cartridges", no translation.

Translation of the international preliminary report on patentability for the corresponding international application; Int. Ref. No. PCT/EP2007/007211.

* cited by examiner

Fig. 5
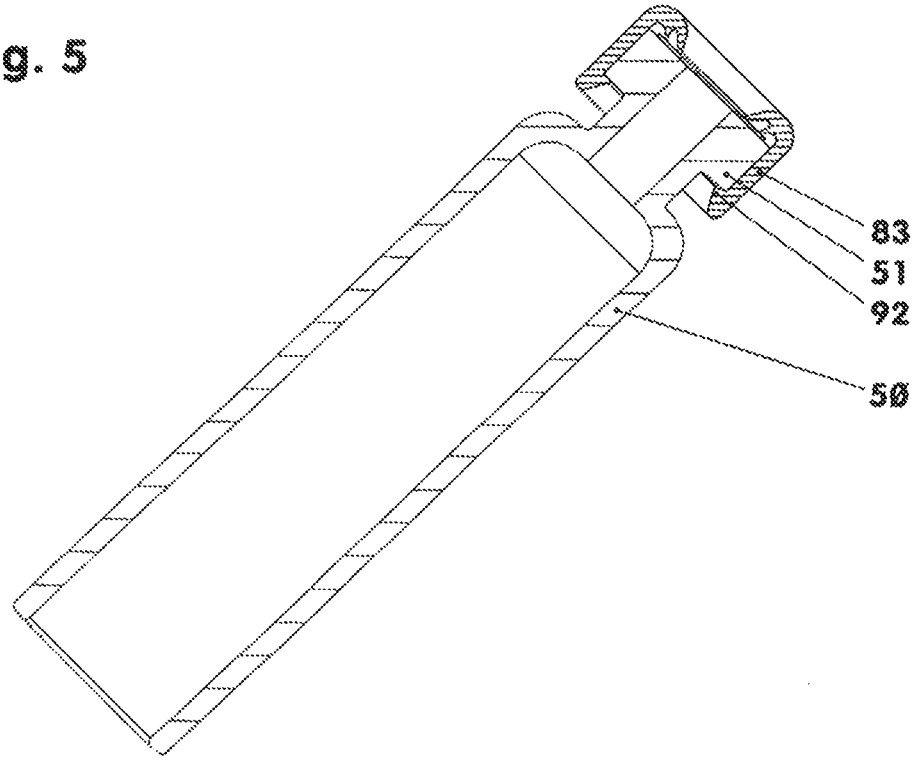
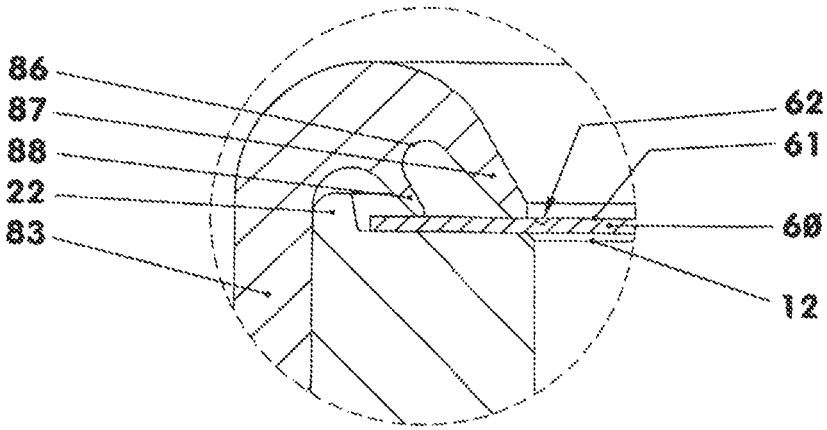
Fig. 7

Fig. 6
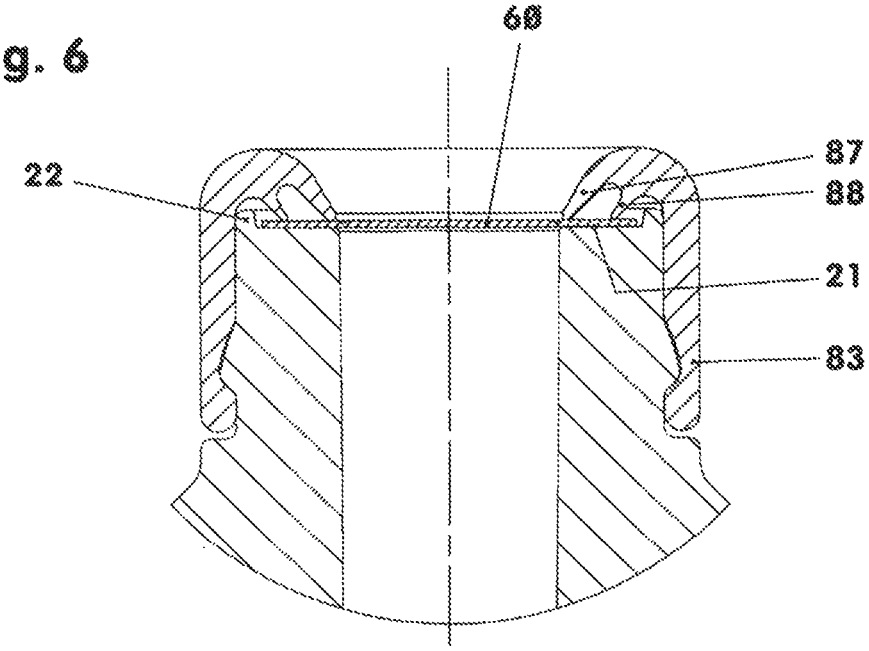
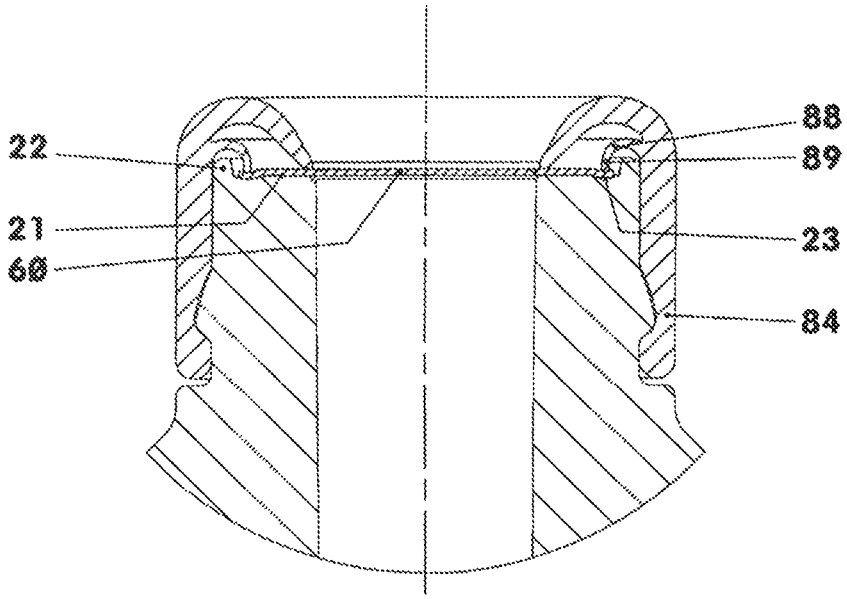
Fig. 8

Fig. 9
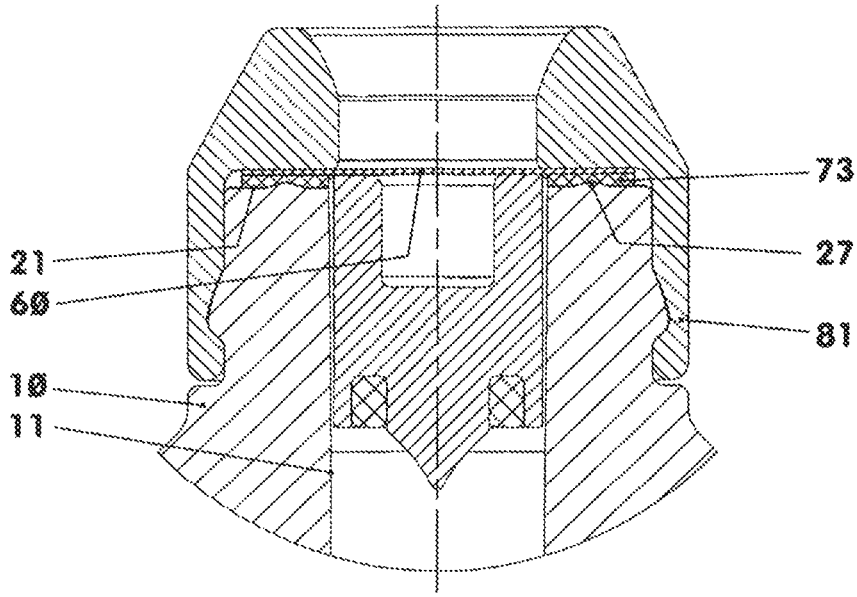
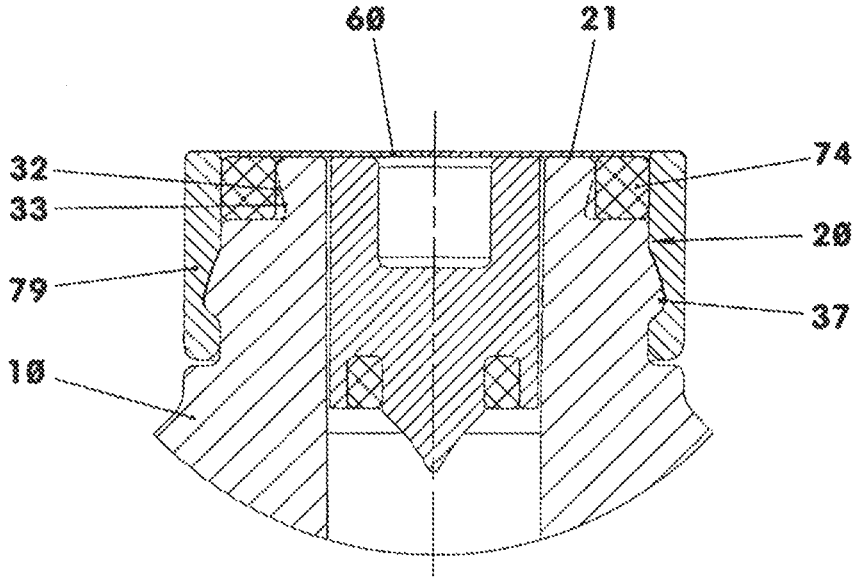
Fig. 10

CLOSURE SYSTEM FOR CONTAINERS

CROSS-REFERENCE TO RELATED APPLICATION

This is a divisional of and claims the benefit of U.S. patent application Ser. No. 12/283,231 filed Sep. 10, 2008 now U.S. Pat. No. 8,256,631, which application is incorporated herein by reference in its entirety. The said U.S. patent application Ser. No. 12/283,231 is a continuation-in-part application of pending international application PCT/EP2007/007211 filed Aug. 16, 2007 and claiming the priority of German Application No. 10 2006 040 888.8 filed Aug. 31, 2006.

BACKGROUND OF THE INVENTION

The invention relates to a closure system for containers used for storing or administering substances in the form of liquids, pastes or powders, which system is composed of a cap, provided with a through-hole, and of a closure element, said cap holding the closure element with a force fit and/or form fit on the container, in the area of the opening that is to be closed, by means of an undercut present on the container.

Aluminum caps for dental vials are known from DIN ISO 11 040 part 3 of year 1993. These caps are used to securely close glass cylinders, for example, by means of piston plugs or sealing discs. For this purpose, after the piston plugs or sealing discs have been applied, the caps are fixed on the glass cylinder by means of a deformation process carried out on the cap. Part 2 of the standard describes, among other things, thin sealing discs made of an elastomeric material.

SUMMARY OF THE INVENTION

The present invention provides a closure system for containers used for storing or administering substances in the form of liquids, pastes or powders, which system in one embodiment includes a container (10, 50) having an opening (12) that is to be closed. A cap (83, 84) is provided with a through-hole (85). The cap (83, 84) including a substantially cylindrical securing area (91), and a closure element (60) for sealing the opening (12). The cap (83, 84) is for holding the closure element (60) with a force fit and/or form fit on the container (10, 50) by means of the securing area (91) of the cap (83, 84) engaging a catch element (37) or a neck (51) present on the container (10, 50) proximate the opening (12). The container (10, 50) includes an end face (21) which surrounds the opening (12) and on which the closure element (60) bears. The closure element (60) comprises a virus-proof, bacteria-proof and spore-proof film. The cap (83, 84) comprises at least one closed, elastic sealing lip (87, 88) bearing resiliently in a direction towards the closure element (60) in the operative position. With the present invention, a closure system for containers is provided that allows the container to be securely closed permanently and in a virus-proof, bacteria-proof and spore-proof manner.

The invention provides a closure system for containers which, without application of thermal energy, and in a mechanically simple way, allows the container to be securely closed permanently in a virus-proof, bacteria-proof and spore-proof manner.

In one of the preferred embodiments of the present invention, the at least one closed, elastic sealing lip (88) is an inner sealing lip (88) and the at least one closed, elastic sealing lip (87) is an outer sealing lip (87). The at least one closed, elastic sealing lip (87, 88) is arranged on the inner face (86) of the cap (83, 84).

In another preferred embodiment of the invention, the at least one closed, elastic sealing lip (88) in the operative position is oriented towards the outside and its individual cross section encloses an angle of 30 to 60 angular degrees relative to the centre line of the container (10, 50).

In yet another embodiment of the invention, the container (10, 50) further includes an abutment edge (22) positioned proximate the outer edge of the end face (21) to surround the film (60) in the operative position.

The abutment edge (22) preferably has a height at least twice the thickness of the film (60). The end face (21) may have a channel (23) therein extending along the abutment edge (22). The closed, elastic sealing lip (88) is for pressing the film (60) into the channel (23) in the operative position. In the area of the opening (12) of the container (10, 50), the film (60) desirably has, in its upper surface (61), a bead (62) in the form of a notch that weakens the film (60).

The invention provides a closure system for containers which is easy and safe to handle and with which substances in the form of liquids, pastes or powders, in particular medicaments, for example pharmaceutical liquids containing proteins, are permanently enclosed in a sealed manner in a container.

BRIEF DESCRIPTION OF THE DRAWINGS

Further details of the invention will become clear from the following illustrative embodiments which are depicted schematically in the Figures, in which:

FIG. 5 shows an elevation cross-sectional schematic view of a carpule with cap and sealing film;

FIG. 6 shows an elevation cross-sectional schematic view of the upper portion of a medicament chamber with a cap that is elastic in relation to the sealing film;

FIG. 7 shows an enlarged detail from FIG. 6;

FIG. 8 shows the same view as in FIG. 6, but with at least one other film contact element;

FIG. 9 shows the same view as in FIG. 4, but with an edge elevation and a flat elastomer ring;

FIG. 10 shows an elevation cross-sectional schematic view of the upper portion of a medicament chamber with clamping ring; and, FIG. 11 shows an elevation cross-sectional schematic view of the upper portion of a medicament chamber without clamping ring and without cap.

DETAILED DESCRIPTION OF THE PREFERRED EMBODIMENTS

Figure 1:
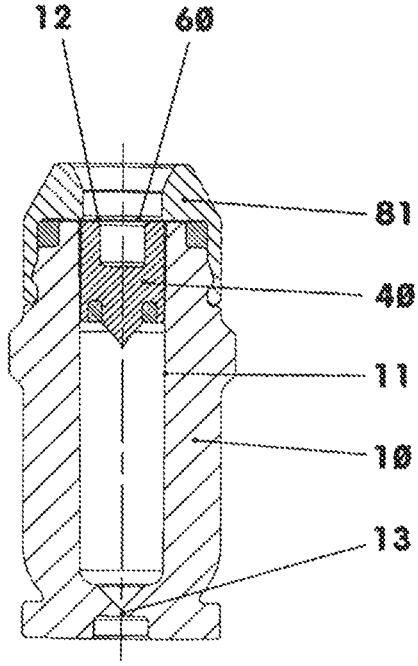
FIG. 1 is an elevation cross-sectional schematic view of a medicament chamber with cap and sealing film.

FIG. 1 shows a container (10) with a piston (40) not part of this invention, and a closure system. The container (10) is designated hereinafter as a medicament chamber.

The medicament chamber (10) may be in combination with the piston (40) not part of this invention, an assembly group of an injection system. The medicament to be administered is initially stored, for example in liquid form, in the medicament chamber (10). For this purpose, the medicament has to be enclosed in the cylinder (11) of the chamber (10) in a virus-proof, bacteria-proof and spore-proof manner. The for example conical cylinder (11) has two openings (12, 13). A front opening (13) is the outlet nozzle. A rear opening (12) is used, inter alia, for filling the cylinder (11). When the chamber (10) is filled, the piston (40) is positioned in the rear area of the cylinder (11). Situated directly behind the piston (40), there is a cap (81) which, with the aid of a closure element (60), closes the rear opening (12) in a virus-proof, bacteria-proof and spore-proof manner. Of course, the container (10) can also be provided with just one opening (12), namely the opening (12) that is closed by the proposed closure system. If appropriate, the closure system can also be gas-tight.

Figure 2:
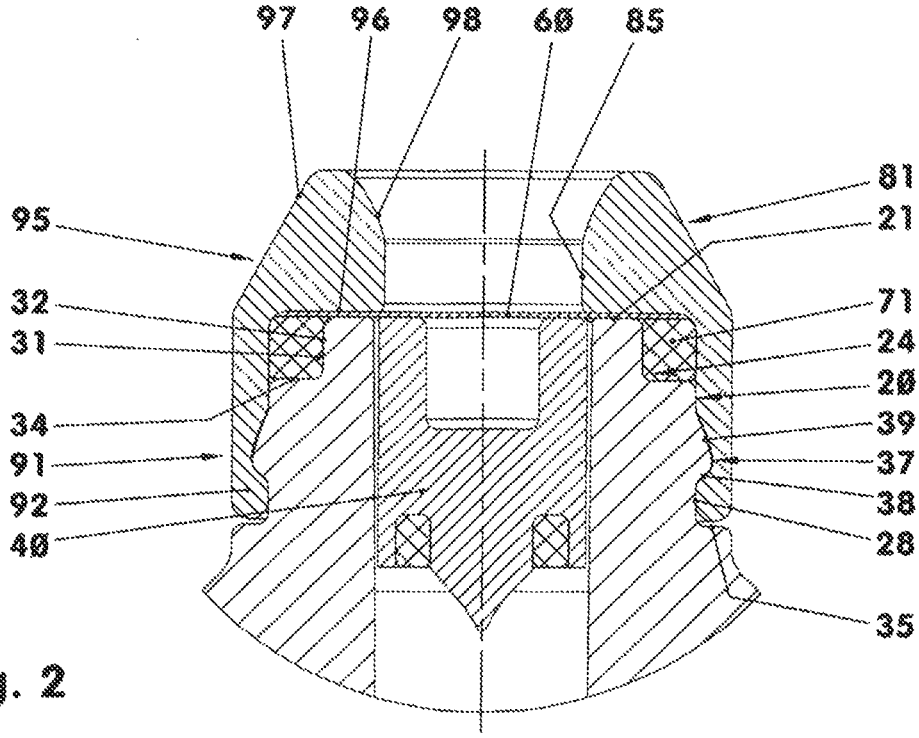
FIG. 2 shows an enlarged partial cross section from FIG. 1.

For fixing the elastic cap (81), the rear area of the chamber (10), made from cyclo-olefin-copolymer (COC) plastic for example, has a defined contour (see FIG. 2). The chamber (10) has a roughly cylindrical tube-shaped endpiece (20) with an end face (21), which is plane for example, and with a cylindrical outer contour (28). At the front, the endpiece (20) ends in a housing collar (35).

In one embodiment not part of this invention, a further housing collar (31) is situated in the transition area between the end face (21) and the cylindrical outer contour (28). The width of this housing collar (31) is, for example, 50% of the wall thickness of the endpiece (20). The depth of this housing collar (31) is slightly greater than its width. The radial flank (32) of the housing collar (31) is cylindrical, while the axial flank (34) is flat.

In the present invention, with regard to the medicament chamber (10), situated below the end face (21), there is a circumferential catch elevation (37), for example with two flanks. Its length corresponds to approximately 50% of the endpiece (20) length and is located between the housing collar (35) and the end face (21). In this illustrative embodiment, the circumferential catch elevation (37), which is situated centrally there for example, is without interruption. The catch elevation (37) has a front flank (38) and a rear flank (39). The rear flank angle is, for example, 17±3 angular degrees, while the front flank angle is, for example, 51±3 angular degrees. The catch elevation (37) is rounded in the area of the zone of contact of the two flanks (38, 39).

According to FIG. 2, the closure element (60) and an elastomer ring (71) which is not part of this invention, sit on the rear end face (21) of the endpiece (20). The closure element (60) is, for example, a sealing film that has a thickness of 0.15 millimeter and is made from an aluminum alloy. The film material can also be comprised of polyethylene fibers as sold under the registered trademark Tyvek®, of the E. I. du Pont de Nemours and Company Corporation, 1007 Market Street Wilmington, Del. 19898, polyethylene (PE), polyethylene terephthalate (PET) or a composite material. The closure element or sealing film (60) is a round, flat and flexible disc. The elastomer ring (71) is made, for example, from silicone rubber, chlorinated rubber or butyl rubber. It is a closed ring with an at least approximately round individual cross section. It is flattened in the area via which it is adhesively bonded or scorched onto the sealing film (60). The sealing film (60) preferably has a material thickness of 50 to 300 mircometers.

The cap (81) is made up of two portions, namely a securing area (91) and a base area (95). The securing area (91) is a substantially cylindrical tube-shaped portion and includes undercut (92) for contacting flank (38) of catch elevation (37) and cylindrical outer contour (28). It engages around the endpiece (20) in the area of the catch elevation (37) provided on the latter. Its inner contour is shaped exactly in such a way that, after the cap (81) has been fitted in place, it sits free of play on the endpiece (20), at least in the area of the flank (38). The inner contour does not bear on the other flank (39), or it bears on the latter in some areas only.

The base area (95), which according to FIG. 2 rests partially with a flat base surface (96) on the sealing film (60), has a frustoconical outer contour (97) and a funnel-shaped central recess (98). The central recess (98), which corresponds to the through-hole (85), has a minimum diameter slightly smaller than the diameter of the rear opening (12) of the cylinder (11). The area of the recess (98) adjoining the base surface (96) is shaped cylindrically. The remaining area of the recess (98) widens rearwards in a funnel shape. This funnel shape facilitates the insertion of a plunger (not shown here) via which the piston (40) in the cylinder (11) is moved when the injector is triggered.

In one embodiment not part of this invention after the medicament chamber (10) has been filled and the piston (40) has been inserted, the sealing film (60), together with the elastomer ring (71), is fitted onto the end face (21) of the chamber (11). The elastomer ring (71) adhering to the sealing film (60) engages centrally around the radial flank (32) of the housing collar (31). When the cap (81) is fitted in place, it slides with its undercut (92) over the catch elevation (37). As soon as the undercut (92) bears on the front flank (38), the cap (81) has reached its end position. The base surface (96) then bears firmly on the sealing film (60). At the same time, the elastomer ring (71) in the area of the housing collar (31) sits sealingly between the cap (81) and the endpiece (20). In the axial direction, the elastomer ring (71) is forced in between the axial flank (34) and the sealing film (60) pressed firmly onto the base surface (96). The clamping force of the cap (81) is here generated, for example, by means of the annular clamping force of the securing area (91).

The housing collar (35) serves as an auxiliary abutment when the cap (81) is being fitted in place.

In small containers in particular, it is also conceivable for the cap to engage round the entire container. In this case, the cap then locks on the base of the container acting as catch element (37).

Figure 3:
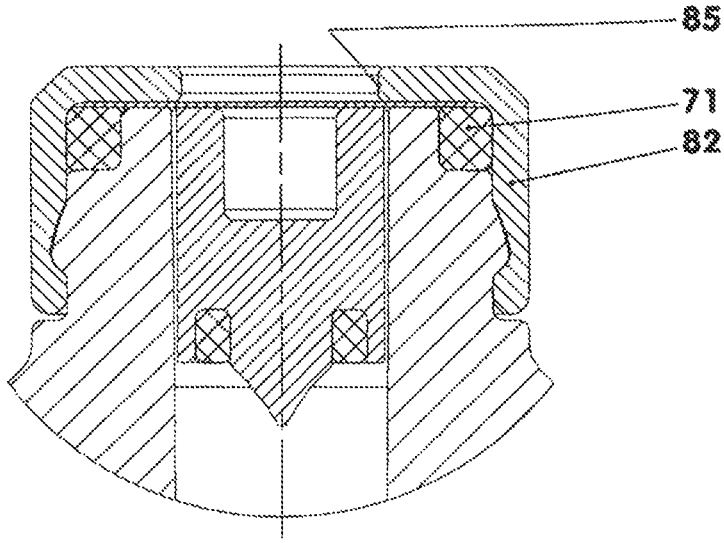
FIG. 3 shows the same view as in FIG. 2, but without the guide cone.

FIG. 3 shows a closure system, not part of this invention, with a simplified cap (82). This cap (82) does not have the insertion funnel (98).

Figure 4:
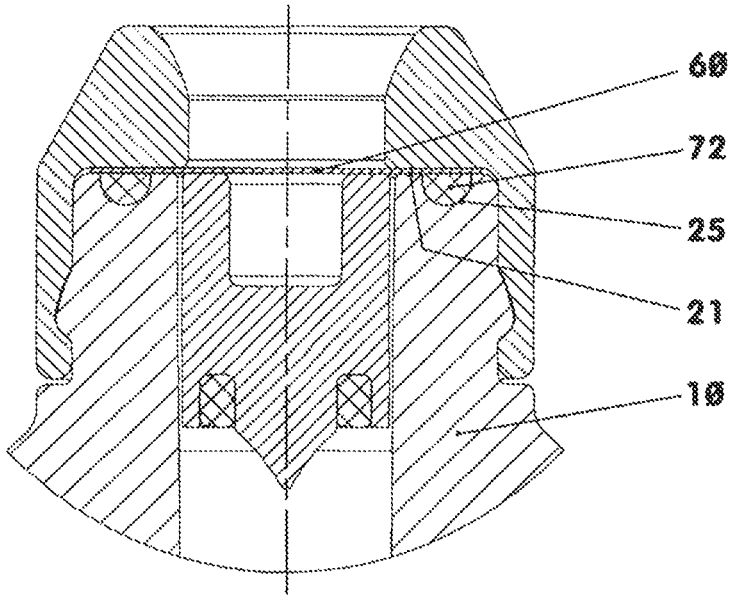
FIG. 4 shows the same view as in FIG. 2, but with a groove-like depression for receiving the elastomer ring.

A further variant of FIG. 2 is shown in FIG. 4 not covered by this invention. In this variant, a depression (25) in the form of an annular channel has been worked radially into the end face (21). The annular channel (25), whose individual cross section is composed of a rectangle surface and a semicircle surface, receives the elastomer ring (72) secured to the sealing film (60). Closed areas of the end face (21) are located to both sides of the annular channel (25). In these areas, the sealing film (60) bears firmly on the end face (21) of the chamber (10).

If appropriate, in this variant, an adhesive can be introduced into the annular channel (25) instead of an elastomer ring (72). This adhesive then bonds the applied sealing film (60) to the chamber (10).

Referring to FIGS. 5-8 with regard to the present invention, in addition to a medicament chamber (10), it is also possible to use a glass vial (50) (see FIG. 5). In this case, a cap (83) engages round the neck (51) of the vial or container (50) with a form fit. The undercut (92) has an individual cross section in the shape of a barb.

In the vial (50), as also in the medicament chamber (10), the end face (21) can be designed sloping down towards the outside. Accordingly, the end face (21) describes a truncated cone for example, with a cone angle of 158±4 angular degrees for example. The imaginary cone tip lies outside the vial (50) or outside the medicament chamber (10).

FIG. 6 of the present invention shows a closure system that does not require an elastomer ring. Instead, the cap (83) has;

for example, two sealing lips (87, 88) that press the sealing film (60) elastically against the end face (21) of the medicament chamber (10) (see also FIG. 7). The first, outer sealing lip (87) is directed towards the atmosphere. It presses the sealing film (60) in the edge area of the opening (12) against the end face (21). In its individual cross section, the sealing lip (87) is inclined by approximately 45 angular degrees relative to the sealing film (60). Its wall thickness is greater here than that of the second, inner sealing lip (88).

The second, inner sealing lip (88) sits in a protected position under the first sealing lip (87). It presses the outer edge area of the sealing film (60) against the end face (21). It too is inclined by approximately 45 angular degrees relative to the sealing film (60). Both sealing lips (87, 88) are made of a permanently elastic material.

To ensure that the sealing film (60) can be placed at least more or less centrally on the end face (21) when assembling the closure system, this variant includes an abutment edge (22) whose height corresponds to at least twice the film thickness of the sealing film (60).

FIG. 7 of the present invention shows an enlarged detail of FIG. 6. This enlargement shows that the sealing film (60), in the area of the edge of the opening (12), has a circumferential bead (62) in the form of a notch in the upper surface (61). The circumferential bead (62) represents a mechanical weakening of the sealing film (60). It is intended to make it easier to tear the film (60) off when administering the medicament.

FIG. 8 of the present invention shows a variant of FIG. 6. The inner sealing lip (88) and the end face (21) here have another configuration. The end face (21) according to FIG. 8 has a channel (23) extending along the abutment edge (22). When the cap (84) is fitted in place, the sealing film (60) is pressed with the aid of the inner sealing lip (88) into this channel (23). The individual cross section of the sealing lip (88) is substantially angled, such that the front area (89) of the sealing lip (88) presses almost at right angles onto the sealing film (60). The rear area of the sealing lip (88) serves as a resilient zone.

When the cap (84) is fitted in place, the inner sealing lip (88) presses the sealing film (60) into the channel (23). In doing so, the sealing film (60) is made taut, such that it lies flat.

If appropriate, the front area (89) of the sealing lip (88) can also point outwards. In this case, the front area is part of a cone surface, the tip of which lies above the upper surface (61) of the sealing film (60) on the continued centre line of the chamber (10). Here, for example, the channel (23) can be omitted.

FIG. 9 shows a closure system, not part of this invention, which has an elevation (27), instead of a circumferential depression, on the end face (21) of the chamber (10) or vial (50). The elevation (27) lies at least approximately centrally in the annular surface of the end face (21). According to FIG. 9, the elevation (27) is formed, for example, by two truncated cone surfaces appearing as a triangle in individual cross section. The elevation can have almost any desired individual cross section. If appropriate, several elevations may also lie next to one another. Moreover, the individual elevation does not have to be arranged concentrically with respect to the centre line of the chamber (10). Nor does it have to be round in plan view.

The sealing film (60) bears on the end face (21) via the elastomer ring (73) that is arranged fixedly on it. The elastomer ring (73) has the shape of a perforated disc. In the compressed state in which it is installed, its material thickness is at least 30% greater than the height of the elevation (27). The elastomer ring (73) here reaches as far as the wall of the cylinder (11). In this variant, the clamping force of the cap (81) is determined by the elasticity of the elastomer ring (73).

Figure 11:
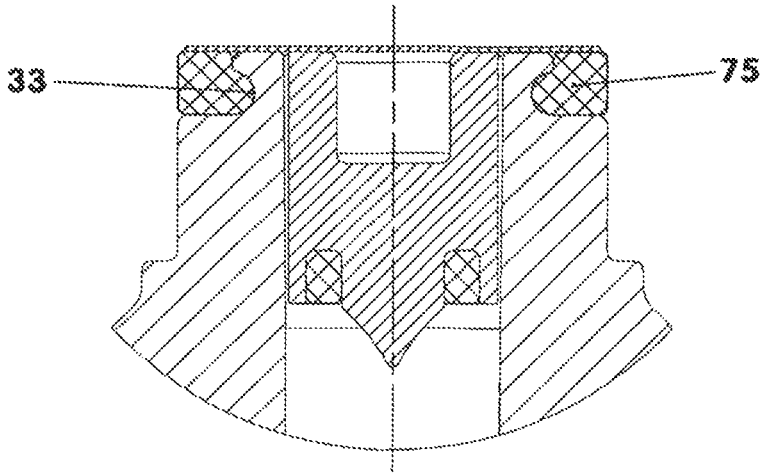

FIGS. 10 and 11 show a closure system variant without cap in another embodiment not part of this invention. This solution is based on a radial clamping force of the corresponding elastomer ring (74, 75). The elastomer ring (74, 75), which adheres to the underside of the elastic sealing film (60), has a smaller mean diameter in the state when not installed. Only upon assembly is it applied with elastic expansion onto the endpiece (20) and there, for example, onto the radial flank (32, 33).

The radial flank can in this case have a cylindrical contour (32) or a non-cylindrical contour (33). In FIG. 10, the contour (33) is shown by broken lines. Starting from the end face (21), its diameter decreases linearly downwards. Accordingly, the flank (33) has the form of a truncated cone surface whose theoretical tip lies, for example, in the central area of the chamber (10).

According to FIG. 10, the elastomer ring (74) is radially supported and clamped by a clamping ring (79). The clamping ring (79) bears both on the elastomer ring (74) and also on the outer contour (28) of the endpiece (20). It is only by way of example that it is shown here as being fixed via the catch elevation (37). The clamping ring (79) finishes flush with the sealing film (60) at the rear end of the chamber. If appropriate, the clamping ring (79) engages only around the elastomer ring (74).

FIG. 11 shows a closure system in which the assembly joint located between the contour (33) and the elastomer ring (75) forms an undercut. If appropriate, the elastomer ring (75), in the uninstalled state, already has a shape matching the contour (33). Here, for example, it is possible to dispense with a clamping ring.

Solutions are also possible in which the variants from FIGS. 1, 4, 6, 8 10 and 11 are superposed at least partially.

The sealing films (60) and if appropriate also the elastomer rings (71-73) can of course have self adhesive virus-proof coatings in the areas where they touch the end face (21) and the depressions (24, 25) or elevations (27).

What is claimed is:

1. A closure system with a container (10, 50) used for storing or administering substances in the form of liquids, pastes or powders, the container (10, 50) having an opening (12) that is to be closed, said closure system comprising a cap (83, 84) provided with an inverted truncated cone-shaped through-passage (85), the cap (83, 84) including a substantially cylindrical securing area (91), and a closure element (60) for sealing the opening (12), the cap (83, 84) for holding the closure element (60) with a force fit and/or form fit on the container (10, 50) by means of the securing area (91) of the cap (83, 84) engaging a catch element (37) or a neck (51) present on the container (10, 50) proximate the opening (12), the container (10, 50) includes an end face (21) which surrounds the opening (12) and on which the closure element (60) bears, the closure element (60) comprises a virus-proof, bacteria-proof and spore-proof film, the closure element (60) over the opening (12) on one side thereof is open to the atmosphere without obstruction via the inverted truncated cone-shaped through-passage (85), the inverted truncated cone-shaped through-passage (85) having a minimum diameter about equal to but smaller than the opening (12)., the inverted truncated cone-shaped through-passage (85) of the cap (83, 84) in the operative position in substantial alignment with the opening (12), the cap (83, 84) comprises an outer elastic sealing lip (87) bearing resiliently in a direction towards and in contact with the closure element (60) in the operative position proximate the opening (12), the outer surface of the outer elastic sealing lip (87) defining the inverted truncated cone-shaped through-passage (85) of the cap (83, 83), and, the cap (83, 84) comprises an inner elastic sealing lip (88) arranged on an inner face (86) of the cap (83,84), the inner elastic sealing lip (88) in the operative position in contacting relationship with the closure element (60) proximate the outer edge thereof.

2. The closure system according to claim 1, wherein said outer elastic sealing lip (87) is also arranged in part on the inner face (86) of the cap (83, 84).

3. The closure system according to claim 1, wherein each of the outer elastic sealing lip (87) and the inner elastic sealing lip (88) in the operative position is oriented towards the outside and its individual cross section encloses an angle of 30 to 60 angular degrees relative to the centre line of the container (10, 50).

4. The closure system according to claim 1, wherein the container (10, 50) further includes an abutment edge (22) positioned proximate the outer edge of the end face (21) to surround the film (60) in the operative position.

5. The closure system according to claim 4, wherein the abutment edge (22) has a height at least twice the thickness of the film (60).

6. The closure system according to claim 4, wherein the end face (21) has a channel (23) therein extending along the abutment edge (22), the inner elastic sealing lip (88) for pressing the film (60) into the channel (23) in the operative position.

7. The closure system according to claim 1, wherein in the area of the opening (12) of the container (10, 50), the film (60) has, in its upper surface (61), a bead (62) in the form of a notch that weakens the film (60).

* * * * *